US012247344B2

(12) United States Patent
Kim et al.

(10) Patent No.: US 12,247,344 B2
(45) Date of Patent: Mar. 11, 2025

(54) LAUNDRY TREATING APPARATUS

(71) Applicant: LG Electronics Inc., Seoul (KR)

(72) Inventors: Sungon Kim, Seoul (KR); Hyuk So, Seoul (KR)

(73) Assignee: LG Electronics Inc., Seoul (KR)

( * ) Notice: Subject to any disclaimer, the term of this patent is extended or adjusted under 35 U.S.C. 154(b) by 636 days.

(21) Appl. No.: 17/487,751

(22) Filed: Sep. 28, 2021

(65) Prior Publication Data

US 2022/0098785 A1 Mar. 31, 2022

(30) Foreign Application Priority Data

Sep. 28, 2020 (KR) ..... 10-2020-0126140

(51) Int. Cl.
*D06F 39/08* (2006.01)
*D06F 39/12* (2006.01)
*D06F 39/40* (2024.01)

(52) U.S. Cl.
CPC ..... *D06F 39/088* (2013.01); *D06F 39/12* (2013.01); *D06F 39/40* (2024.01)

(58) Field of Classification Search
CPC ..... D06F 39/12; D06F 39/40; D06F 39/08; D06F 39/088; D06F 39/083; D06F 37/266
See application file for complete search history.

(56) References Cited

U.S. PATENT DOCUMENTS

2009/0249840 A1* 10/2009 Jo ..... D06F 39/088 68/58
2011/0100070 A1* 5/2011 Kim ..... D06F 39/088 68/200

FOREIGN PATENT DOCUMENTS

CN 106120253 B * 1/2019 ..... D06F 39/08
KR 20110025566 A * 3/2011

OTHER PUBLICATIONS

Machine Translation of Lim et al., KR-20110025566-A, Mar. 2011. (Year: 2011).*
Machine Translation of Ding et al., CN-106120253-B, Jan. 2019. (Year: 2019).*

* cited by examiner

*Primary Examiner* — David G Cormier
(74) *Attorney, Agent, or Firm* — Fish & Richardson P.C.

(57) ABSTRACT

A laundry treating apparatus includes a cabinet having an inlet of laundry defined therein, a tub disposed inside the cabinet and storing wash water therein, a drum rotatably disposed in the tub, wherein washing of the laundry is performed in the drum, a gasket that connects the inlet to the tub and prevents wash water stored in the tub from leaking, and a front nozzle assembly disposed on an inner circumferential surface of the gasket to spray wash water to the laundry of the drum and the inner circumferential surface of the gasket.

17 Claims, 12 Drawing Sheets

B - B'

LAUNDRY TREATING APPARATUS

CROSS-REFERENCE TO RELATED APPLICATIONS

This application claims the benefit of Korean Patent Application No. 10-2020-0126140, filed on Sep. 28, 2020, which is hereby incorporated by reference as if fully set forth herein.

TECHNICAL FIELD

The present disclosure relates to a laundry treating apparatus, and more particularly, to a laundry treating apparatus including a flow path structure for allowing washing of a gasket of the laundry treating apparatus.

BACKGROUND

In general, a drum washing scheme is a scheme for performing washing using a friction force between laundry and a drum, which is rotated by receiving a driving force of a motor in a state in which detergent, wash water, and the laundry are put into the drum.

A drum washer according to the prior art has a cabinet in which an inlet into which laundry is put is defined, a tub for storing wash water therein, and a drum that is rotatably disposed inside the tub and accommodates the laundry therein. In addition, a gasket for preventing vibration of the tub from being transmitted to the cabinet while forming a watertight state between the cabinet and the tub is further disposed between the inlet of the cabinet and the tub.

In a case of a general washing machine, a washing/rinsing process of the laundry is performed by the wash water (or wash water containing the detergent) stored in the tub using a rotational force of the drum. In this connection, as the drum is rotated for the washing/rinsing of the laundry, the wash water is scattered forwardly toward the gasket from an interior of the tub and an interior of the drum.

In one example, the gasket may be formed in a shape of a bellows corrugated in a circumferential direction with a material having a predetermined elastic force in order to maintain the watertightness between the cabinet and the tub and to prevent the vibration of the tub from being transmitted to the cabinet.

Therefore, the wash water or detergent foam scattered and generated by the rotation of the drum in the washing/rinsing process of the laundry may be introduced into the gasket in the bellows shape from the interior of the tub or the drum. The wash water introduced into the gasket of the bellows shape may not drain when the wash water is drained from the tub and may remain in the gasket.

The wash water remaining in the gasket as such may cause odors in the washing machine when left for a long time. When a next washing process is performed in a state in which the residual and contaminated wash water is not treated, the contaminated residual wash water and freshly supplied wash water may be mixed with each other, which may cause a problem in that the laundry is poorly washed.

SUMMARY

The present disclosure has been devised to solve the problems as described above, and an object of the present disclosure is to provide a laundry treating apparatus that allows a surface of a gasket to be washed.

In addition, the present disclosure has been devised to solve the problems as described above, and an object of the present disclosure is to provide a laundry treating apparatus that allows a surface of a gasket to be washed by spraying wash water onto the surface of the gasket when the wash water is supplied.

In addition, the present disclosure has been devised to solve the problems as described above, and an object of the present disclosure is to provide a laundry treating apparatus that has a washing nozzle that sprays a portion of wash water to an inner surface of a gasket when diffusing and supplying the wash water into a drum.

In an aspect of the present disclosure, provided is a laundry treating apparatus including a cabinet having an inlet of laundry defined therein, a tub disposed inside the cabinet and storing wash water therein, a drum rotatably disposed in the tub, wherein washing of the laundry is performed in the drum, a gasket for connecting the inlet and the tub to each other, wherein the gasket prevents wash water stored in the tub from leaking, and a front nozzle assembly disposed on an inner circumferential surface of the gasket to spray wash water to the laundry of the drum and the inner circumferential surface of the gasket.

In one implementation, a nozzle-fastened portion may be formed on an upper portion of the inner circumferential surface of the gasket, and the front nozzle assembly may be inserted into and fastened with the nozzle-fastened portion.

In one implementation, the front nozzle assembly may include a spray nozzle for spraying wash water into the drum, a first washing nozzle for spraying wash water to one side of the inner circumferential surface of the gasket, and a second washing nozzle for spraying wash water to the other side of the inner circumferential surface of the gasket.

In one implementation, the spray nozzle may further include a diffusion plate formed to face toward the interior of the drum, and diffusing wash water sprayed from the spray nozzle.

In one implementation, the first washing nozzle and the second washing nozzle may spray wash water toward the inner circumferential surface of the gasket so as to be inclined toward the drum from the inlet.

In one implementation, the first washing nozzle and the second washing nozzle may spray wash water toward the inner circumferential surface of the gasket upwardly of the first washing nozzle and the second washing nozzle.

In one implementation, the front nozzle assembly may be located eccentrically with respect to a center of an upper portion of the gasket, and the first washing nozzle and the second washing nozzle may be located at different vertical levels based on a degree of the eccentricity.

In one implementation, left and right portions of each of the first washing nozzle and the second washing nozzle may have different heights with respect to a spray direction of each nozzle.

In one implementation, the front nozzle assembly may include a fastening plate fastened in contact with the inner circumferential surface of the gasket, a front water supply hose-connected tube extending from the fastening plate to penetrate the gasket, and having a hollow for wash water to flow defined therein, and a spray nozzle cap for spraying wash water flowing through the hollow into the drum, and one side and the other side of the inner circumferential surface of the gasket.

In one implementation, the spray nozzle cap may include a spray nozzle for guiding wash water flowing through the hollow into the drum, a first washing nozzle for spraying wash water flowing through the hollow to one side of the gasket, and a second washing nozzle for spraying wash water flowing through the hollow to the other side of the gasket.

In one implementation, a chamber having a diameter smaller than a diameter of the hollow may be formed below the hollow, and the spray nozzle, the first washing nozzle, and the second washing nozzle may be connected to the chamber.

In one implementation, the laundry treating apparatus may further include a steam generator for generating steam, and the front nozzle assembly may further include a steam supply hose-connected tube extending from the fastening plate to penetrate the gasket, and having a hollow for steam to flow defined therein, and a steam nozzle cap for spraying steam flowing through the hollow into the drum.

The laundry treating apparatus according to an embodiment of the present disclosure has the effect of washing the surface of the gasket.

In addition, the laundry treating apparatus according to an embodiment of the present disclosure has the effect of washing the surface of the gasket by spraying the wash water onto the surface of the gasket when the wash water is supplied.

In addition, the laundry treating apparatus according to an embodiment of the present disclosure has the effect of washing the gasket by having the washing nozzle that sprays the portion of the wash water to the inner surface of the gasket when diffusing and supplying the wash water into the drum.

DETAILED DESCRIPTION

Figure 1:
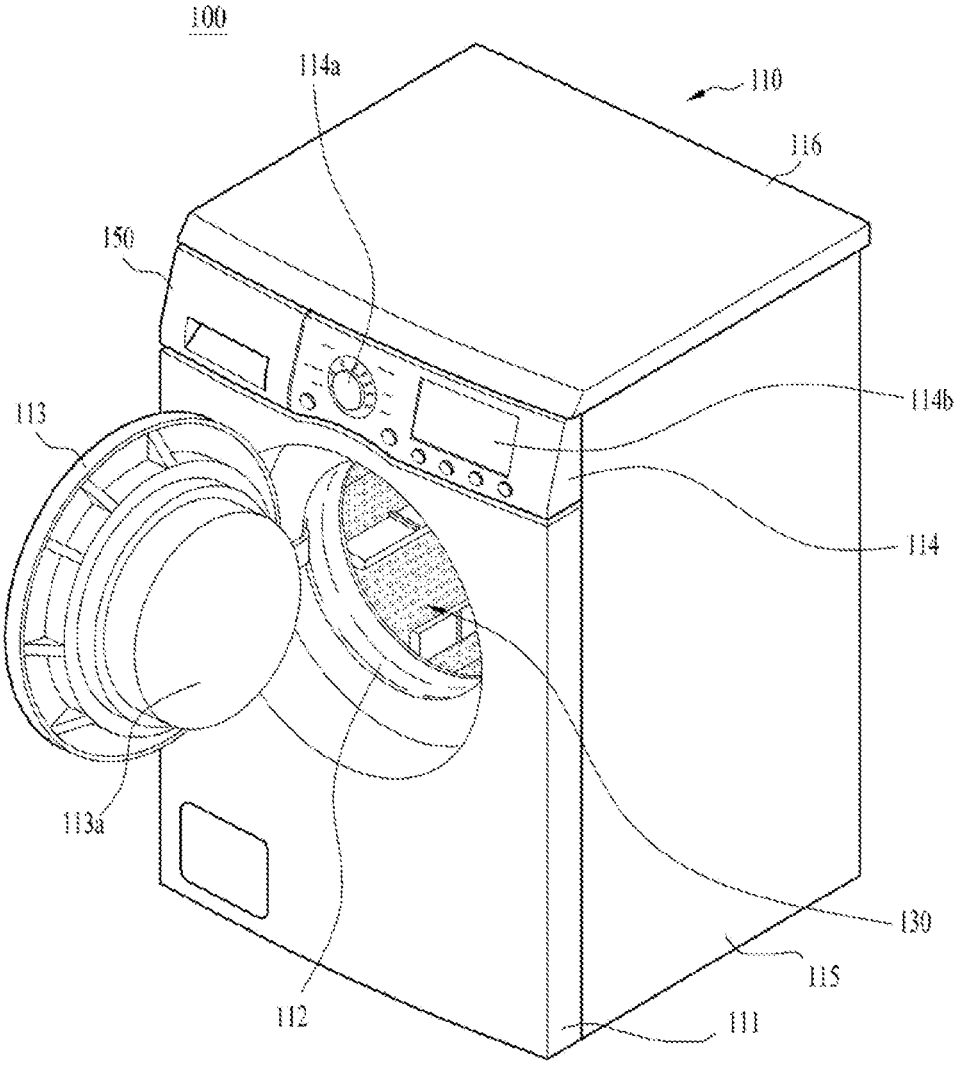
FIG. 1 is a perspective view showing a laundry treating apparatus according to an embodiment of the present disclosure.

Hereinafter, a laundry treating apparatus according to an embodiment of the present disclosure will be described in detail.

In describing the present disclosure, the defined name of each component is defined in consideration of a function thereof in the present disclosure. Therefore, it should not be construed as limiting the technical component of the present disclosure. In addition, each name defined for each component may be referred to as another name in the art.

Therefore, the present disclosure is not limited to the following embodiment, and various modifications and variations are possible from such description by those having ordinary knowledge in the technical field to which the present disclosure belongs. When such modifications include the main components of the present disclosure, it may be seen as being included in the present disclosure.

In addition, regardless of the reference numerals, the same or corresponding components are given the same reference numbers, and duplicate descriptions thereof will be omitted. For convenience of description, the size and the shape of each component shown may be exaggerated or reduced.

In one example, it will be understood that, although the terms "first", "second", "third", and so on may be used herein to describe various components, these components should not be limited by these terms. These terms are used to distinguish one component from another component.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

First, each component of a laundry treating apparatus according to an embodiment of the present disclosure will be described in detail with reference to the accompanying drawings.

Figure 2:
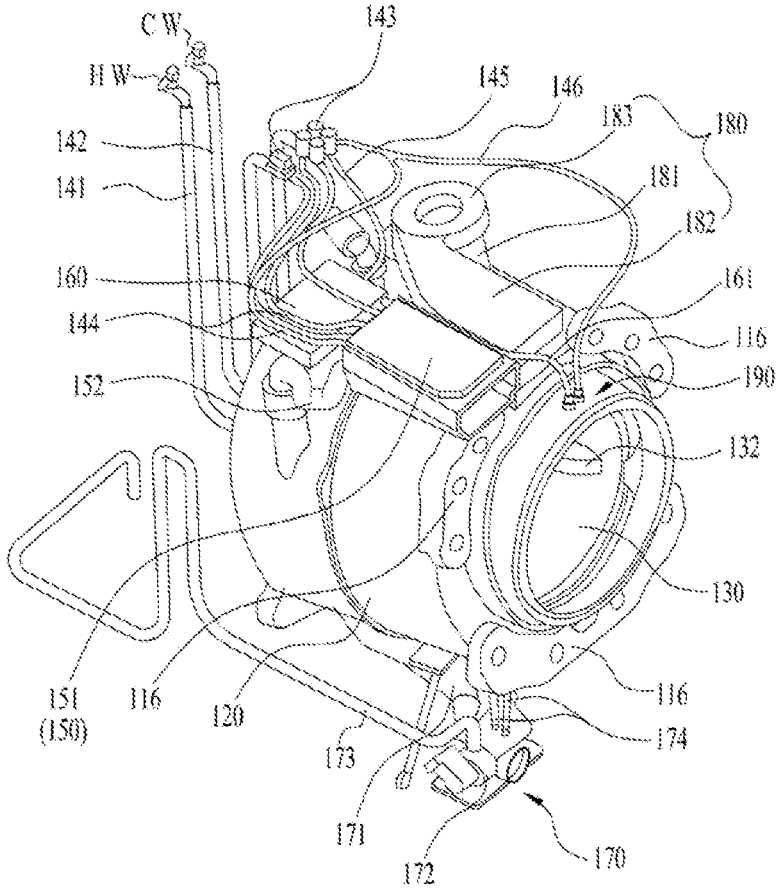
FIG. 2 is a simplified view showing an internal structure of a laundry treating apparatus according to an embodiment of the present disclosure.
Figure 3:
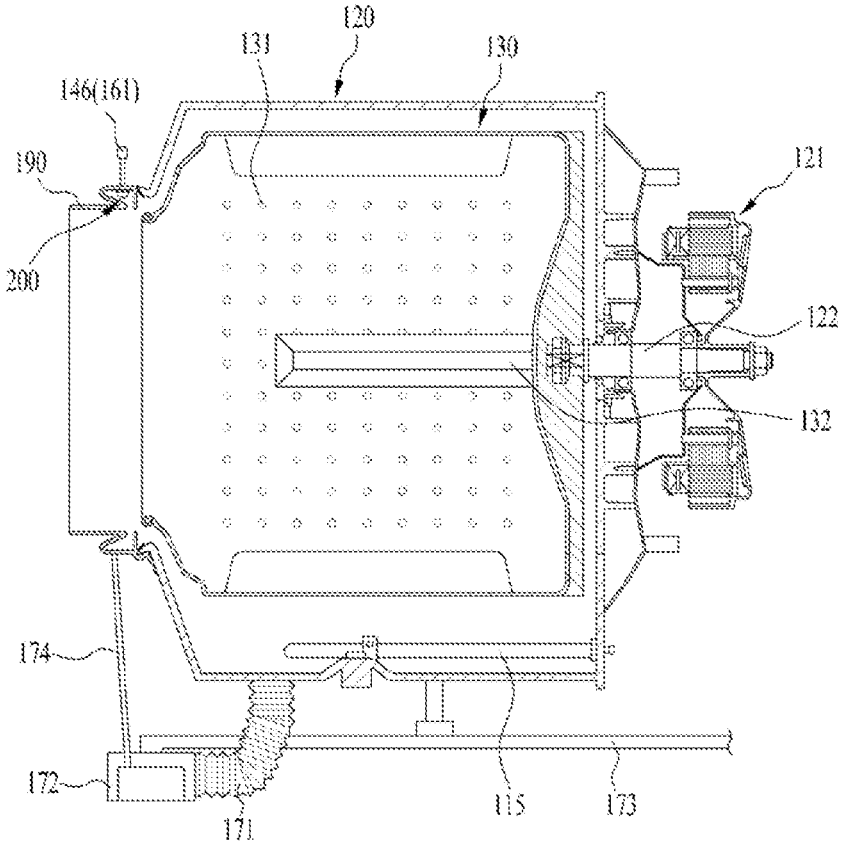
FIG. 3 is a cross-sectional view showing a main part of a laundry treating apparatus according to an embodiment of the present disclosure.
Figure 4:
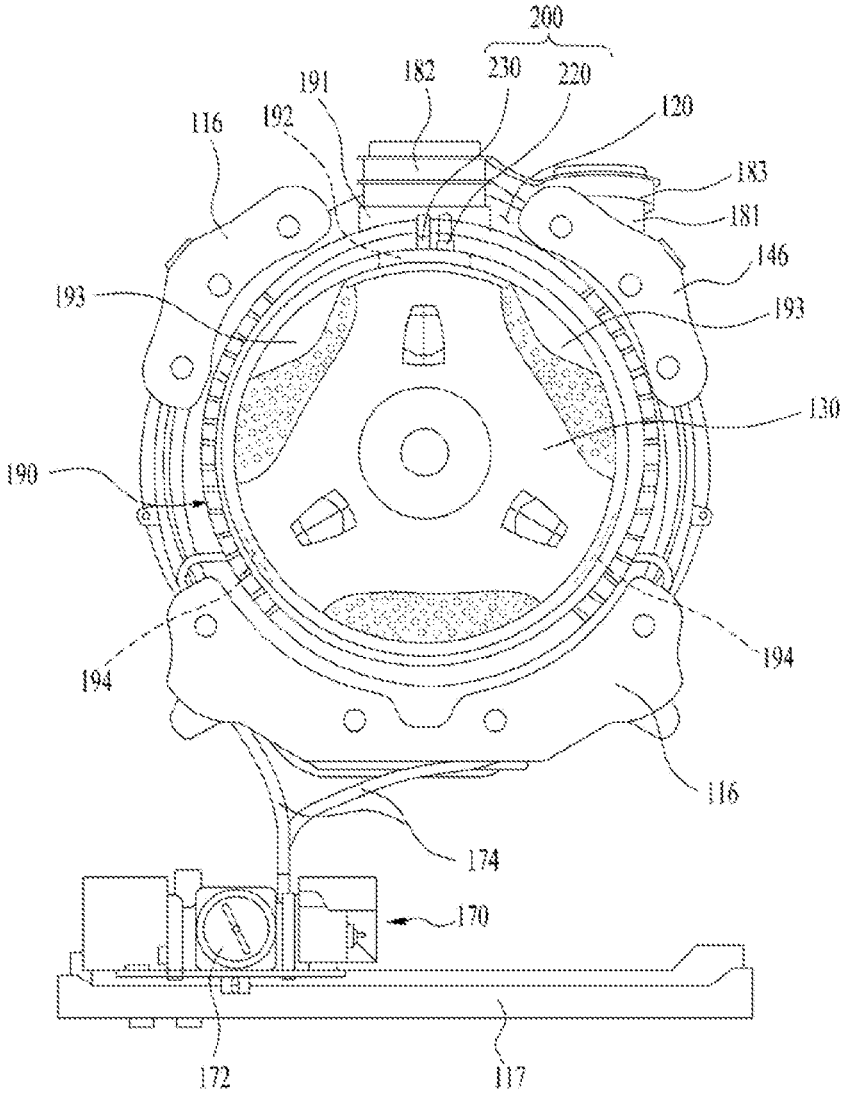
FIG. 4 is a front view showing a main part of a laundry treating apparatus according to an embodiment of the present disclosure.

FIG. 1 is a perspective view showing a laundry treating apparatus according to an embodiment of the present disclosure, FIG. 2 is a simplified view showing an internal structure of a laundry treating apparatus according to an embodiment of the present disclosure, FIG. 3 is a cross-sectional view showing a main part of a laundry treating apparatus according to an embodiment of the present disclosure, and FIG. 4 is a front view showing a main part of a laundry treating apparatus according to an embodiment of the present disclosure.

As shown in FIGS. 1 to 4, a laundry treating apparatus 100 according to an embodiment of the present disclosure may include a cabinet 110 that forms an appearance of the laundry treating apparatus 100, a tub 120 disposed inside the cabinet 110 and storing wash water therein, a drum 130 that is rotatably disposed inside the tub 120, a water supplier 140 for supplying the wash water to the tub 120, a detergent dispenser 150 that mixes the water supplied from the water supplier 140 with detergent to form a mixture and supplies the mixture to the tub 120, a steam generator 160 that heats the water supplied from the water supplier 140 to supply steam to the tub 120, a drainage 170 that discharges the wash water after washing, and a dryer 180 that heats air in the tub 120 and supplies/circulates the heated air.

In one example, the laundry treating apparatus of the present disclosure has a gasket 190 between the cabinet 110 and the tub 120. The gasket 190 is for preventing the water stored in the tub 120 from leaking to a location between the tub 120 and the cabinet 110.

In this connection, a front nozzle assembly 200 for supplying water supplied from a water supply source HW and CH into the drum 130 and to an inner surface of the gasket 190 at the same time may be disposed on top of the gasket 190. Circulation nozzles 194 for the wash water supplied to the tub 120 to be circulated by the drainage 170 and then circulated back to the tub 120 may be disposed on both sides of the gasket 190, respectively.

In addition, the front nozzle assembly 200 may further include a spray nozzle assembly 220 for spraying the wash water supplied from the water supplier 140 into the drum and to the gasket, and a steam nozzle assembly 230 for supplying the steam generated from the steam generator 160 into the drum 130. The front nozzle assembly 200 will be described in detail after the description of the laundry treating apparatus 100 is completed.

The cabinet 110, which forms the appearance of the laundry treating apparatus 100, may include side surface cabinets 115 forming side surfaces of the laundry treating apparatus 100, a base 117 forming a bottom surface of the laundry treating apparatus 100, a front surface cabinet 111 having a laundry inlet 112 defined therein such that laundry may be put into or withdrawn from the laundry treating apparatus 100, and coupled to front surfaces of the side surface cabinets 115, a top surface cabinet 116 disposed on top of the side surface cabinets 115, and a door 113 that is pivotably fastened to the front surface cabinet 111 to open and close the laundry inlet 112.

In one example, a control panel 114 is disposed on an upper portion of the front surface cabinet 111. The control panel 114 may include a course selection unit 114*a* for receiving course selection input from a user, and a display 114*b* for receiving various control commands from the user and displaying an operating state of the laundry treating apparatus 100.

In addition, the door 113 may have a glass 113*a* such that the laundry inside the drum 130 may be observed from the outside of the laundry treating apparatus 100. The glass 113*a* may be formed in a convex shape, and a tip of the glass 113*a* may protrude up to an interior of the drum 130 in a state in which the door 113 is closed.

The tub 120 may be formed in a shape suspended inside the cabinet 110. A motor 121 and a rotation shaft 122 for rotating the drum 130 may be disposed at the rear of the tub 120. In this connection, the drum 130 may be divided into a direct driving-type drum and an indirect driving-type drum based on a scheme of transferring a driving force provided from the motor to the drum 130. In this connection, in the direct driving scheme, the rotation shaft of the motor is directly fastened with the drum 130, and the rotation shaft of the motor and a center of the drum 130 are aligned on the same line.

The laundry treating apparatus 100 according to the present embodiment follows such direct driving scheme, and the drum 130 is rotated by the motor 121 disposed at the rear of the tub 120. However, the present disclosure is not necessarily limited thereto, and the indirect driving scheme to be described later is also applicable.

In the indirect driving scheme, the drum 130 is rotated using power transmission means such as a belt or a pulley that transmits the driving force provided from the motor, and the rotation shaft of the motor and the center of the drum 130 are not necessarily aligned on the same line.

The tub 120 as described above may be suspended from the cabinet 110 by a spring (not shown), and may further have a damper (not shown) for supporting the tub 120 from below such that vibration generated when the drum 130 rotates may be buffered.

In addition, a heater 115 for heating water stored in the tub 120 may be further disposed inside the tub 120. In one example, a weight 116 for increasing a weight of the tub 120 itself to raise a vibration limit of the tub may be disposed on a front surface of the tub 120.

The drum 130 is disposed inside the tub to be rotatable by being connected to the rotation shaft to receive a rotational force of the motor 121. A plurality of through-holes 131 may be defined in an inner circumferential surface of the drum 130 such that the wash water stored in the tub 120 may flow into the drum 130. In addition, one or more lifters 132 may be disposed on an inner surface of the drum 130 along the inner circumferential surface of the drum 130 such that the laundry put into the drum 130 may be moved by the rotation of the drum 130.

In one example, the tub 120 and the drum 130 may be disposed in a horizontal state, but alternatively, may be disposed to have a predetermined inclination such that rear portions of the tub 120 and the drum 130 are positioned lower than front portions thereof.

The water supplier 140 may be composed of a plurality of water supply valves 143 and a plurality of water supply hoses 144, 145, and 146 to supply detergent supplied from an external water supply source HW and CW to the tub 120, the detergent dispenser 150, the steam generator 160, and the like.

In this connection, the water supplier 140 may be connected to a hot water supply source HW for supplying hot water and a cold water supply source CW for supplying cold water through a hot water hose 141 and a cold water hose 142, respectively. The water introduced through the hot water hose 141 and the cold water hose 142 may be supplied to the detergent dispenser 150, the steam generator 160, and/or the front nozzle assembly 200 through appropriate control of the water supply valve 143.

Such water supplier 140 may include a dispenser water supply hose 144 for guiding water to the detergent dispenser 150, a steam water supply hose 145 for guiding water to the steam generator 160, and a front water supply hose 146 for guiding the water to the front nozzle assembly 200.

The detergent dispenser 150 may temporarily store an additive such as detergent for preliminary or main laundry washing, fabric softener, bleach, and the like, and may mix the wash water supplied as the water supplier 140 supplies the water, and the additive with each other to form the mixture and supply the mixture to the tub 120.

In one example, the detergent dispenser 150 may have a plurality of accommodation spaces defined therein compartmentalized such that the accommodated additives may be separately accommodated without mixing with each other, and water may be independently supplied to each accommodation space.

Such detergent dispenser 150 may have a dispenser housing 151 formed in a shape to be recessed into the cabinet 110, and may be formed in a drawer shape so as to be extendable forwardly of the cabinet 110 from the detergent dispenser housing 151.

In this connection, the dispenser housing 151 is in communication with the tub 120 through a water supply bellows 152. Therefore, after passing through the detergent dispenser 150 and being mixed with the additive, the water supplied by the water supplier 140 may flow into the tub 120 along the water supply bellows 152 connected to the dispenser housing 151.

The steam generator 160 is an apparatus for generating steam by heating the water supplied from the water supplier 140. The steam generator 160 may supply the generated steam from the front of the drum 130 to perform sterilization, wrinkle removal, and the like of the laundry inside the drum 130. For example, the steam generator 160 can include a heater configured to heat the water supplied from the water supplier 140. In some cases, the steam generator 160 can include a pipe, a reservoir, etc. that can receive the water.

The drainage 170 is disposed underneath the tub 120 to drain the wash water that has completed the laundry washing in the tub 120. The drainage 170 may include a drain bellows 171 connected to a bottom surface of the tub 120, a drain pump 172 for pumping the wash water drained through the drain bellows 171, a drain hose 173 for draining the wash water flowed by the drain pump 172, and a circulation hose 174 that circulates the wash water flowed by the drain pump 172 to the tub.

In this connection, the drain hose 173 may be extended by forming a trap on a portion of the drain hose 173 disposed outside the laundry treating apparatus 100. At least two circulation hoses 174 may be disposed, and may be connected to circulation nozzles 194 (not shown) formed on both sides of a gasket 190.

Therefore, when the drain pump 172 is operated, the wash water of the tub 120 may be drained through the drain hose 173, or the wash water of the tub 120 may be supplied to the tub 120 again through the circulation nozzle 194. To this end, the drain pump 172 may have a separate three-way valve (not shown) that sets a flow path such that the water flowed by the drain pump 172 is selectively flowed to the drain hose 173 or the circulation hose 174.

In this connection, in the present embodiment, the drain pump 172 has been described to perform both the function of the drain pump and the function of the circulation pump. Alternatively, a pump for drainage and a pump for circulation may be disposed separately.

The dryer 180 heats and circulates the air inside the tub 120, and guides flow of the air such that the air is guided back into the tub 120. The dryer 180 may include a suction duct 181 for sucking the air in the tub 120 and a supply duct 182 for guiding the flowing air to the tub 120.

In one example, a blowing fan 183 for generating a pressure for flowing the air is disposed between the suction duct 181 and the supply duct 182. The suction duct 181 connects a rear outer circumferential surface of the tub 120 and the blowing fan 183 to each other, and the supply duct 182 connects the blowing fan 183 and the gasket 190 to each other. In addition, a heater 115 for heating the air flowing through the supply duct 182 may be further disposed inside the supply duct 182.

Figure 12:
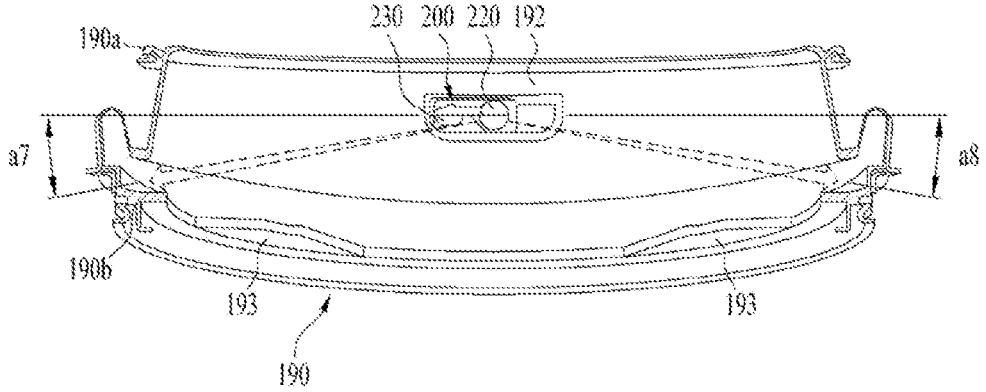

An inlet-fastened portion 190*a* to be coupled to the front surface cabinet 111 is formed on one side of the gasket 190, and a tub-fastened portion 190*b* coupled to a circumference of the opened front surface of the tub 120 is formed on the other side of the gasket 190 (see FIG. 12). In addition, a portion between the inlet-fastened portion 190*a* and the tub-fastened portion 190*b* may be formed in a shape of a bellows that is elastically folded based on the vibration of the tub 120 to buffer the vibration.

In this connection, the gasket 190 may be made of a deformable or flexible material having some elasticity, and may be formed using natural rubber or synthetic resin. In addition, the gasket 190 may be formed in a shape of a bellows tube on which a corrugation is formed in a direction toward the front surface cabinet 111 or the tub 120 to flexibly respond to the vibration of the tub 120.

In one example, as described above, a duct-connected portion 191 to which the supply duct 182 of the dryer 180 is connected may be formed on an upper rear portion of the gasket 190, and a nozzle-fastened portion 192 to which the front nozzle assembly 200 is fastened may be formed on an upper front portion of the gasket 190.

In addition, jamming prevention protrusions 193 are respectively formed on both sides of an upper portion of an inner circumferential surface of the gasket 190 in a symmetrical form to protrude in a center direction of the gasket 190. The jamming prevention protrusions 193 are to prevent the laundry from deviating from the drum 130 by the rotation of the drum 130 and getting jammed between the gasket 190 and the cabinet 110, in particular, the front surface cabinet 111, or to prevent the laundry from spilling when opening the door 113 after the washing is completed.

Preferably, the jamming prevention protrusions 193 may be formed to protrude from the inner circumferential surface of the gasket 190 toward the laundry inlet. In addition, the jamming prevention protrusions 193 may be formed at a plurality of positions, and in particular, may be formed at positions symmetrical to each other with respect to a vertical center line of the gasket 190.

In one example, the plurality of circulation nozzles 194 for spraying water into the drum 130 may be formed on both sides of a lower portion of the inner circumferential surface of the gasket 190. Each circulation nozzle 194 may be connected to each circulation hose 174 extending from the drainage 170.

The plurality of circulation nozzles 194 have an effect of evenly wetting the laundry put into the drum by spraying the wash water rearwardly of the drum 130 from the lower portion of the gasket 190.

In this connection, each circulation nozzle 194 may be integrally formed with the gasket 190. For example, the circulation nozzle 194 and the gasket 190 may be integrally molded through injection molding of the synthetic resin. The circulation nozzle 194 may be formed to protrude from the inner circumferential surface of the gasket 190 toward the center of the gasket.

In the present embodiment, it has been described that the water is sprayed by the two circulation nozzles 194, but the scope of the present disclosure is not limited thereto, and it is also possible that two or more gasket nozzles are disposed to spray the water into the drum 130 in a plurality of directions.

Additionally, the circulation nozzle 194 may be further formed inwardly of the jamming prevention protrusion 193 described above. When the circulation nozzle 194 is formed inwardly of the jamming prevention protrusion 193, because the wash water is sprayed from the upper portion of the gasket 190 to a lower portion of the drum 130, the wash water may be sprayed over a wider area.

Hereinafter, the front nozzle assembly, which is the main part of the present disclosure, will be described in detail with reference to the accompanying drawings.

Figure 5:
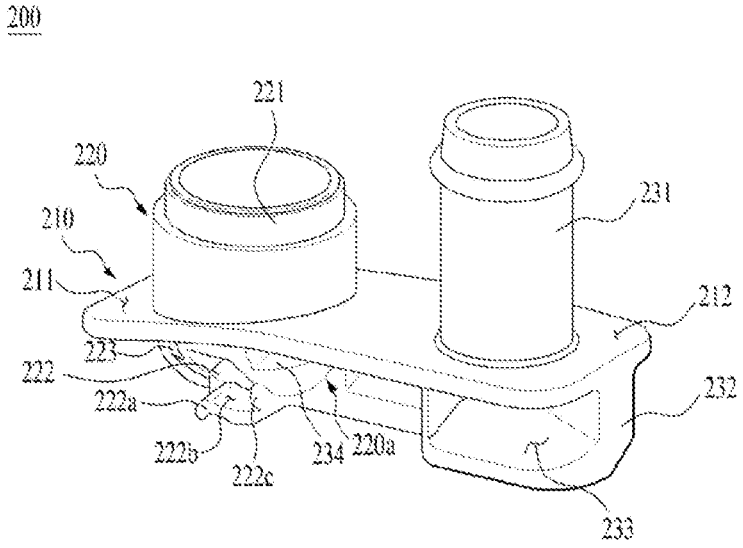
FIG. 5 is a perspective view showing a front nozzle assembly according to an embodiment of the present disclosure.
Figure 6:
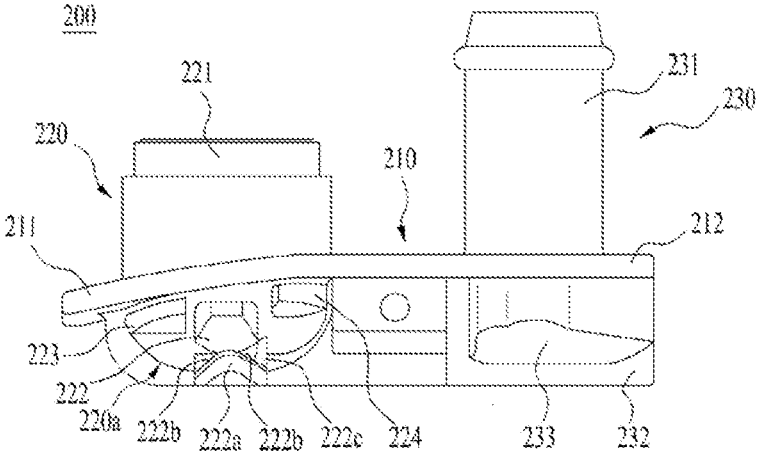
FIG. 6 is a rear view showing a rear surface of a front nozzle assembly according to an embodiment of the present disclosure.

FIG. 5 is a perspective view showing a front nozzle assembly according to an embodiment of the present disclosure, and FIG. 6 is a rear view showing a rear surface of a front nozzle assembly according to an embodiment of the present disclosure.

As shown, the front nozzle assembly 200 according to the present disclosure is fastened to the nozzle-fastened portion 192 of the gasket 190 as described above. The front nozzle assembly 200 may include the spray nozzle assembly 220 and the steam nozzle assembly 230.

In this connection, the spray nozzle assembly 220 and the steam nozzle assembly 230 may be integrally formed by injection molding using synthetic resin, and the spray nozzle assembly 220 and the steam nozzle assembly 230 may be formed as separate components. When the spray nozzle assembly 220 and the steam nozzle assembly 230 are integrally formed, as the front nozzle assembly 200 is fastened to the nozzle-fastened portion 192, the spray nozzle assembly 220 and the steam nozzle assembly 230 may be simultaneously fastened to the gasket 190.

Hereinafter, in the description according to an embodiment of the present disclosure, the spray nozzle assembly 220 and the steam nozzle assembly 230 are integrally formed as an example. However, a shape of the front nozzle assembly 200 is not limited thereto. When a component includes a function and a structure of the spray nozzle assembly 220, which is the main component of the present disclosure, it should be considered that the corresponding component is included in the front nozzle assembly 200 of the present disclosure.

In one example, the front nozzle assembly 200 has a fastening plate 210 in contact with the inner circumferential surface of the gasket 190 when the front nozzle assembly 200 is fastened to the nozzle-fastened portion 192. The spray nozzle assembly 220 may be formed on one side of the fastening plate 210, and the steam nozzle assembly 230 may be formed on the other side of the fastening plate 210.

In this connection, the nozzle-fastened portion 192 to which the front nozzle assembly 200 is fastened may be positioned so as to be eccentric to one side with respect to a center of the upper portion of the gasket 190. That is, the front nozzle assembly 200 has the spray nozzle assembly 220 and the steam nozzle assembly 230, and the installation position of the front nozzle assembly 200 is able to be eccentric such that the spray nozzle assembly 220 or the steam nozzle assembly 230 is located at the center of the upper portion of the gasket based on a diffusion degree of the wash water sprayed from the spray nozzle assembly 220 and s diffusion degree of the steam sprayed from the steam nozzle assembly 230. In the present disclosure, it will be described that the front nozzle assembly 200 is installed eccentrically such that the spray nozzle assembly 220 is located at the center of the gasket 190 as an example.

As the spray nozzle assembly 220 is eccentrically positioned on the gasket as described above, a flat surface 212 in a flat surface shape may be formed at a portion of the fastening plate 210 where the steam nozzle assembly 230 is located corresponding to the inner circumferential surface of the gasket 190, and a curved surface 211 in a curved surface shape may be formed at a portion of the fastening plate 210 where the spray nozzle assembly 220 is positioned corresponding to the inner circumferential surface of the gasket 190.

The spray nozzle assembly 220 includes a front water supply hose-connected tube 221, which is disposed above the fastening plate 210, to which the front water supply hose 146 is connected at a location above the fastening plate 210, a spray nozzle 222 in communication with the front water supply hose-connected tube and spraying the wash water into the drum 130, a first washing nozzle 223 for spraying the wash water to the inner circumferential surface of the gasket 190 on which the front nozzle assembly 200 is installed, and a spray nozzle cap 220*a* having a second washing nozzle 224.

The steam nozzle assembly 230 includes a steam supply hose-connected tube 231, which is disposed above the fastening plate 210, to which a steam supply hose 161 is connected at a location above the fastening plate 210, and a steam nozzle cap 232 in which a steam outlet 233 for spraying the steam into the drum 130 is defined.

In one example, the fastening plate 210, the spray nozzle assembly 220, and the steam nozzle assembly 230 may be integrally injection-molded with the same material.

Hereinafter, the spray nozzle assembly 220 will be described in detail with reference to the accompanying drawings.

Figure 7:
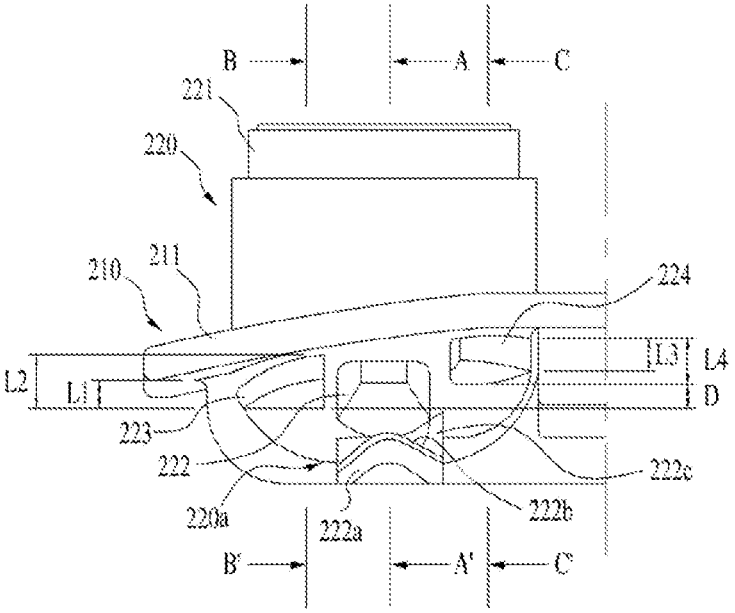
FIG. 7 is an enlarged view showing a main part of a front nozzle assembly according to an embodiment of the present disclosure.
Figure 8:
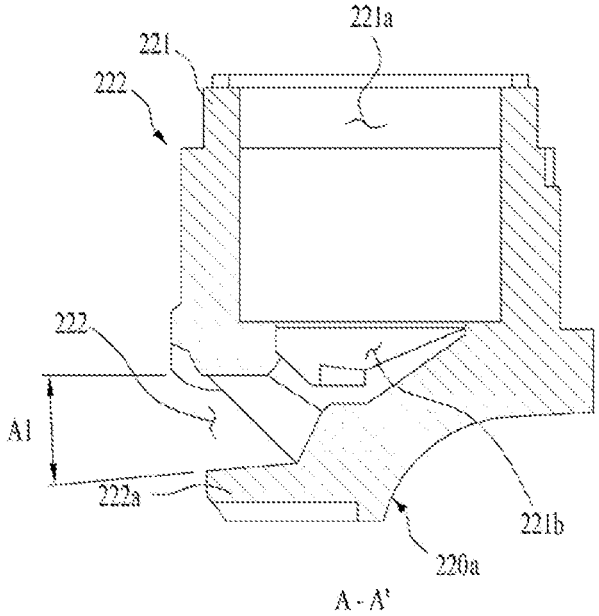
FIG. 8 is a cross-sectional view taken along a line A-A' in FIG. 7.
Figure 9:
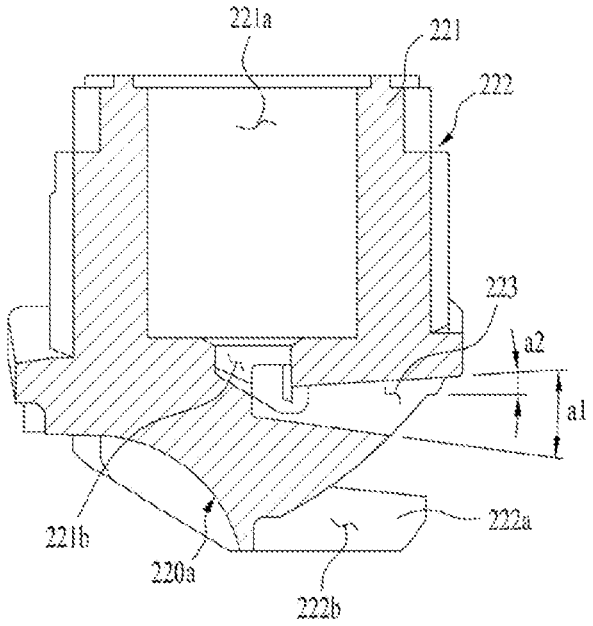
FIG. 9 is a cross-sectional view taken along a line B-B' in FIG. 7.
Figure 10:
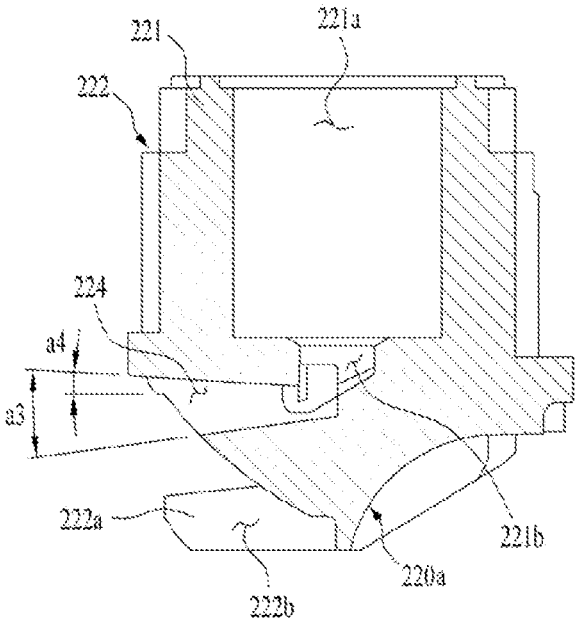
FIG. 10 is a cross-sectional view taken along a line C-C' in FIG. 7.

FIG. 7 is an enlarged view showing a main part of a front nozzle assembly according to an embodiment of the present disclosure, FIG. 8 is a cross-sectional view taken along a line A-A' in FIG. 7, FIG. 9 is a cross-sectional view taken along a line B-B' in FIG. 7, and FIG. 10 is a cross-sectional view taken along a line C-C' in FIG. 7.

As shown in FIG. 7, the spray nozzle assembly 220 has the front water supply hose-connected tube 221 formed on top of the fastening plate 210, and the spray nozzle cap 220*a* formed beneath the fastening plate 210 and protruding in a hemispherical shape. A hollow 221*a* in communication with the spray nozzle 222, the first washing nozzle 223, and the second washing nozzle 224 is defined inside the front water supply hose-connected tube 221 and the spray nozzle cap 220*a*.

In this connection, a nozzle chamber 221*b* in communication with the spray nozzle 222, the first washing nozzle 223, and the second washing nozzle 224 is formed beneath the hollow 221*a* (see FIGS. 8 to 10). The nozzle chamber 221*b* is formed with a diameter or area relatively smaller than a diameter of the hollow 221*a*, and the wash water flowing through the hollow 221*a* may temporarily increase in the pressure while passing through the nozzle chamber 221*b* to be supplied to the spray nozzle 222, the first washing nozzle 223, and the second washing nozzle 224.

The spray nozzle 222, the first washing nozzle 223, and the second washing nozzle 224 formed in the spray nozzle cap 220*a* may be constructed to independently spray the wash water to the inner surface of the drum 130, and one side and the other side of the gasket 190, respectively.

Specifically, the spray nozzle 222 may be formed to face the interior of the drum 130, the first washing nozzle 223 may be formed to face one side of the inner circumferential surface of the gasket 190, and the second washing nozzle 224 may be formed to face the other side of the inner circumferential surface of the gasket 190. In addition, the first washing nozzle 223 and the second washing nozzle 224 may be constructed to spray the wash water in relatively opposite directions.

In this connection, the spray nozzle 222, the first washing nozzle 223, and the second washing nozzle 224 may be formed to have relatively similar nozzle areas, and the spray nozzle 222 may have a relatively large area compared to the first washing nozzle 223 and the second washing nozzle 224. In the case of the spray nozzle 222, the wash water must be sprayed at a relatively greater distance (that is, to an inner portion of the interior of the drum 130) than distances at which the wash water is sprayed from the first washing nozzle 223 and the second washing nozzle 224, so that it is preferable to have a slightly larger area than the first washing nozzle 223 and the second washing nozzle 224.

In one example, the first washing nozzle 223 and the second washing nozzle 224 should spray the wash water in the opposite directions, and left and right portions of each of the first washing nozzle 223 and the second washing nozzle 224 may have different heights such that the sprayed wash water has directionality and diffusivity.

That is, the spray nozzle cap 220*a* may be formed in the hemispherical shape underneath the fastening plate 210, and the first washing nozzle 223 and the second washing nozzle 224 formed in the spray nozzle cap 220*a* may be formed on both sides of the spray nozzle cap 220*a*.

In this connection, among left and right sides of the first washing nozzle 223, a height L2 of the other side facing toward the center of the drum 130 may be greater than a height L1 of one side facing toward the inner circumferential surface of the gasket 190. Therefore, in the wash water sprayed from the first washing nozzle 223, an amount of wash water sprayed from the other side may be greater than an amount of wash water sprayed from one side of the first washing nozzle 223, and a direction and a diffusion degree of the wash water sprayed from the first washing nozzle 223 may vary.

In addition, left and right sides of the second washing nozzle 224, a height L4 of the other side facing toward inner circumferential surface of the gasket 190 may be greater than a height L3 of one side facing toward the center of the drum 130. Therefore, in the wash water sprayed from the second washing nozzle 224, an amount of wash water sprayed from the other side may be greater than an amount of wash water sprayed from one side of the second washing nozzle 224, and a direction and a diffusion degree of the wash water sprayed from the second washing nozzle 224 may vary.

In addition, as the spray nozzle assembly 220 is located eccentrically with respect to the center of the gasket 190, by differentiating the formation positions of the first washing nozzle 223 and the second washing nozzle 224, the wash water sprayed from the first washing nozzle and the second washing nozzle may be sprayed to relatively equal positions on both sides of the inner circumferential surface of the gasket.

Specifically, the first washing nozzle 223 is positioned downwardly of the second washing nozzle 224 by a predetermined height D. As the spray nozzle assembly 220 is eccentrically positioned, it will be possible to compensate for a difference in the spray distance of the wash water based on the difference in the vertical level between the first washing nozzle 223 and the second washing nozzle 224.

In one example, the spray nozzle 222 may be formed to face toward the inner surface of the drum 130 at a center of the spray nozzle assembly 220 as shown in FIGS. 7 and 8. Such spray nozzle 222 is formed to spray the wash water in a downward direction with a predetermined angle A1 from an extension line of a top surface of the drum 130.

A diffusion plate 222*a* that diffuses the wash water sprayed from the spray nozzle 222 to the inner surface of the drum 130 may be further disposed below the spray nozzle 222 in the spray direction of the spray nozzle 222. The diffusion plate 222*a* may have a curved surface 222*b*, which is inclined in a left and right direction, oriented in the direction of the wash water sprayed from the spray nozzle 222 such that the wash water sprayed from the spray nozzle 222 is diffused in a left and right direction of the drum 130. The diffusion degree of the wash water of the spray nozzle 222 may be adjusted by changing the inclination of the curved surface 222*b*.

In one example, the spray nozzle assembly 220 may be located eccentrically from the center of the gasket 190. In this case, the wash water sprayed from the spray nozzle 222 may also be sprayed eccentrically from the center of the drum 130. In order to adjust the direction of the wash water sprayed from the spray nozzle 222, at one side between the spray nozzle 222 and the diffusion plate 222*a*, a blocking plate 222*c* for reflecting the wash water sprayed from the spray nozzle 222 in an opposite direction may be further disposed.

The first washing nozzle 223 may spray the wash water toward one side of the inner circumferential surface of the gasket 190 as shown in FIGS. 7 to 9, and may wash foreign substances such as detergent foam, lint, and the like that may remain on one side of the inner circumferential surface of the gasket.

Such first washing nozzle 223 may be formed to expand to have a predetermined angle a1 in order to spray the wash water to one side of the gasket 190. Based on the expansion angle a1 of the first washing nozzle 223, it is possible to adjust the diffusion degree of the wash water sprayed from the first washing nozzle 223.

In addition, the spray nozzle cap 220*a* in which the first washing nozzle 223 is formed is formed at a lower portion of the spray nozzle assembly 220, and the spray nozzle assembly 220 may be fixed in a form of being fastened to the top surface of the gasket 190. Therefore, the first washing nozzle 223 formed in the spray nozzle cap 220*a* is inevitably formed at a position lower than an upper end of the gasket 190. Accordingly, the first washing nozzle may be formed upwardly of a horizontal plane by a predetermined angle a2 such that the wash water sprayed from the first washing nozzle 223 is sprayed to one side of the inner circumferential surface of the gasket 190 as wide as possible.

The second washing nozzle 224 may spray the wash water toward the other side of the inner circumferential surface of the gasket 190 as shown in FIGS. 7 to 10, and may wash foreign substances such as detergent foam, lint, and the like that may remain on the other side of the inner circumferential surface of the gasket.

Such second washing nozzle 224 may be formed to expand to have a predetermined angle a3 in order to spray the wash water to the other side of the gasket 190. Based on the expansion angle a3 of the second washing nozzle 224, it is possible to adjust the diffusion degree of the wash water sprayed from the second washing nozzle 224.

In addition, the spray nozzle cap 220*a* in which the second washing nozzle 224 is formed is formed at the lower portion of the spray nozzle assembly 220, and the spray nozzle assembly 220 may be fixed in the form of being fastened to the top surface of the gasket 190. Therefore, the second washing nozzle 224 formed in the spray nozzle cap 220*a* is inevitably formed at a position lower than the upper end of the gasket 190. Accordingly, the second washing nozzle may be formed upwardly of the horizontal plane by a predetermined angle a4 such that the wash water sprayed from the second washing nozzle 224 is sprayed to the other side of the inner circumferential surface of the gasket 190 as wide as possible.

The steam nozzle assembly 230 includes the steam supply hose-connected tube 231, which is disposed on the other side of the fastening plate 210, to which the steam supply hose 161 is connected at the location above the fastening plate 210, and the steam nozzle cap 232 formed beneath the fastening plate 210 and having the steam outlet 233, which is directed inwardly of the drum, for spraying the steam into the drum 130.

In this connection, the steam supply hose-connected tube 231 and the steam nozzle assembly 230 may have the hollow 221*a* for the steam to flow defined therein, and the hollow 221*a* may guide the flow of the steam to the steam outlet.

Figure 11:
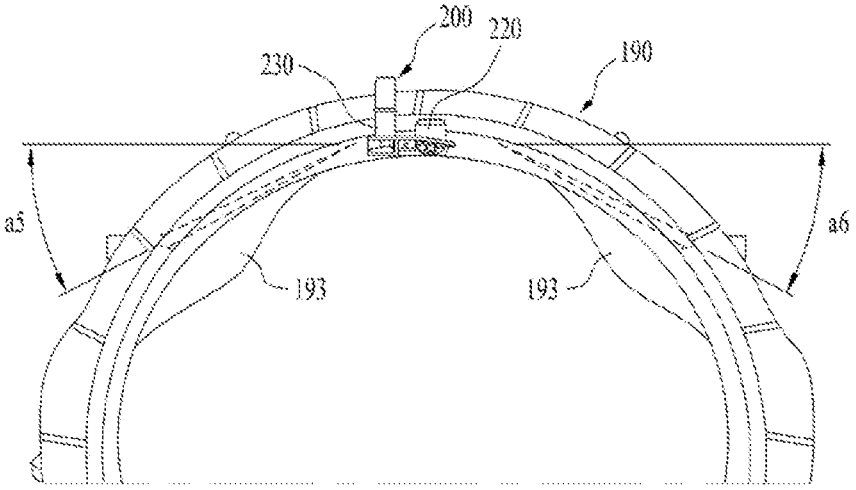
FIGS. 11 to 12 are simplified views showing a spray state of a front nozzle assembly according to an embodiment of the present disclosure.

In one example, as shown in FIGS. 11 and 12, the wash water sprayed from the first washing nozzle 223 and the second washing nozzle 224 as described above with predetermined angles a5 and a6 may flow downward by their own weights toward the inner circumferential surface of the gasket 190, respectively. In addition, the first washing nozzle 223 and the second washing nozzle 224 may be formed to be inclined at predetermined angles a7 and a8 such that the wash water sprayed therefrom may flow from the tub-fastened portion 190*b* toward the inlet-fastened portion 190*a*.

As such, the wash water sprayed from the first washing nozzle 223 and the second washing nozzle 224 may be sprayed onto a surface of the bellows formed between the tub-fastened portion 190*b* and the inlet-fastened portion 190*a* of the gasket, and may wash detergent foam, lint, or the like remaining on the surface of the gasket 190.

As described above, the preferred embodiment of the present disclosure has been described in detail, but a person with ordinary skill in the technical field to which the present disclosure belongs will be able to implement the present disclosure in various ways without departing from the spirit and scope of the present disclosure defined in the appended claims. Therefore, future changes in embodiments of the present disclosure will not be able to deviate from the description of the present disclosure.

What is claimed is:

1. A laundry treating apparatus comprising:

a cabinet having an inlet configured to receive laundry therethrough;

a tub disposed in the cabinet and configured to receive wash water;

a drum rotatably disposed in the tub and configured to accommodate the laundry therein;

a steam generator configured to generate steam;

a gasket that connects the inlet of the cabinet to the tub and is configured to block the wash water in the tub from leaking out of the tub, the gasket defining a nozzle-fastened portion that passes through a top surface of the gasket; and a front nozzle assembly disposed at an inner circumferential surface of the gasket and configured to spray the wash water to an interior of the drum and to the inner circumferential surface of the gasket, wherein the front nozzle assembly comprises:

a fastening plate that is coupled to and in contact with the inner circumferential surface of the gasket, a water supply tube that extends from the fastening plate and passes through the gasket, a spray nozzle cap configured to spray the wash water from the water supply tube into the drum, a first side of the inner circumferential surface of the gasket, and a second side of the inner circumferential surface of the gasket, a steam supply tube that extends from the fastening plate and passes through the gasket, and a steam nozzle cap configured to spray the steam from the steam supply tube into the drum, wherein the spray nozzle cap comprises:

a spray nozzle configured to spray the wash water into the drum, a first washing nozzle configured to spray the wash water to the first side of the inner circumferential surface of the gasket, and a second washing nozzle configured to spray the wash water to the second side of the inner circumferential surface of the gasket, wherein a nozzle area of the spray nozzle is greater than a nozzle area of each of the first washing nozzle and the second washing nozzle, and wherein the spray nozzle is disposed at a portion of the spray nozzle cap between the first washing nozzle and the second washing nozzle.

2. The laundry treating apparatus of claim 1, wherein the front nozzle assembly further comprises a diffusion plate that faces the interior of the drum and that is configured to diffuse the wash water sprayed from the spray nozzle.

3. The laundry treating apparatus of claim 2, wherein the first washing nozzle and the second washing nozzle are configured to spray the wash water toward the inner circumferential surface of the gasket in directions that are inclined toward the drum with respect to the inlet of the cabinet.

4. The laundry treating apparatus of claim 2, wherein the first washing nozzle and the second washing nozzle are configured spray the wash water toward positions of the inner circumferential surface of the gasket above the first washing nozzle and the second washing nozzle.

5. The laundry treating apparatus of claim 2, wherein the front nozzle assembly is located eccentrically with respect to a center of an upper portion of the gasket, and wherein the first washing nozzle and the second washing nozzle are located at different vertical levels with respect to the center of the upper portion of the gasket.

6. The laundry treating apparatus of claim 2, wherein left and right portions of the first washing nozzle have different heights from each other with respect to a spray direction of the first washing nozzle, and wherein left and right portions of the second washing nozzle have different heights from each other with respect to a spray direction of the second washing nozzle.

7. The laundry treating apparatus of claim 1, wherein the front nozzle assembly has a chamber defined below the water supply tube and connected to the spray nozzle, the first washing nozzle, and the second washing nozzle, and wherein a diameter of the chamber is less than an inner diameter of the water supply tube.

8. A laundry treating apparatus comprising:

a cabinet having an inlet configured to receive laundry therethrough;

a tub disposed in the cabinet and configured to receive wash water;

a drum rotatably disposed in the tub and configured to accommodate the laundry therein;

a gasket that connects the inlet of the cabinet to the tub and is configured to block the wash water in the tub from leaking; and a front nozzle assembly disposed at an inner circumferential surface of the gasket and configured to spray the wash water to an interior of the drum and to the inner circumferential surface of the gasket, wherein the front nozzle assembly comprises a spray nozzle cap configured to spray the wash water into the drum, a first side of the inner circumferential surface of the gasket, and a second side of the inner circumferential surface of the gasket, wherein the spray nozzle cap comprises:

a spray nozzle configured to spray the wash water into the drum, a first washing nozzle configured to spray the wash water to the first side of the inner circumferential surface of the gasket, and a second washing nozzle configured to spray the wash water to the second side of the inner circumferential surface of the gasket, wherein a nozzle area of the spray nozzle is greater than a nozzle area of each of the first washing nozzle and the second washing nozzle, and wherein the spray nozzle is disposed at a portion of the spray nozzle cap between the first washing nozzle and the second washing nozzle.

9. The laundry treating apparatus of claim 8, wherein the gasket defines a nozzle-fastened portion at an upper portion of the inner circumferential surface of the gasket, and wherein the front nozzle assembly is inserted into and fastened to the nozzle-fastened portion.

10. The laundry treating apparatus of claim 8, wherein the front nozzle assembly further comprises a diffusion plate that faces the interior of the drum and is configured to diffuse the wash water sprayed from the spray nozzle.

11. The laundry treating apparatus of claim 8, wherein the first washing nozzle and the second washing nozzle are configured to spray the wash water toward the inner circumferential surface of the gasket in directions that are inclined toward the drum with respect to the inlet of the cabinet.

12. The laundry treating apparatus of claim 8, wherein the first washing nozzle and the second washing nozzle are configured to spray the wash water toward positions of the inner circumferential surface of the gasket above the first washing nozzle and the second washing nozzle.

13. The laundry treating apparatus of claim 8, wherein the front nozzle assembly is located eccentrically with respect to a center of an upper portion of the gasket, and wherein the first washing nozzle and the second washing nozzle are located at different vertical levels with respect to the center of the upper portion of the gasket.

14. The laundry treating apparatus of claim 8, wherein left and right portions of the first washing nozzle have different heights from each other with respect to a spray direction of the first washing nozzle, and wherein left and right portions of the second washing nozzle have different heights from each other with respect to a spray direction of the second washing nozzle.

15. The laundry treating apparatus of claim 8, wherein the front nozzle assembly further comprises:

a fastening plate that is coupled to and in contact with the inner circumferential surface of the gasket; and a water supply tube that extends from the fastening plate and passes through the gasket.

16. The laundry treating apparatus of claim 15, wherein the front nozzle assembly has a chamber defined below the water supply tube and connected to the spray nozzle, the first washing nozzle, and the second washing nozzle, and wherein a diameter of the chamber is less than an inner diameter of the water supply tube.

17. The laundry treating apparatus of claim 15, further comprising a steam generator configured to generate steam, wherein the front nozzle assembly further comprises:

a steam supply tube that extends from the fastening plate and passes through the gasket, and a steam nozzle cap configured to spray the steam from the steam supply tube into the drum.

* * * * *